US010441827B2

(12) United States Patent
Robey et al.

(10) Patent No.: US 10,441,827 B2
(45) Date of Patent: Oct. 15, 2019

(54) HYBRID SELF-RESCUE EQUIPMENT

(75) Inventors: Eric J. Robey, Colliers, WV (US); Robert H. Sell, Oakdale, PA (US); Thomas J. Pitzer, McDonald, PA (US); William E. Dedig, Jr., Pittsburgh, PA (US)

(73) Assignee: Draeger Medical Systems, Inc., Andover, MA (US)

( * ) Notice: Subject to any disclaimer, the term of this patent is extended or adjusted under 35 U.S.C. 154(b) by 663 days.

(21) Appl. No.: 14/365,026

(22) PCT Filed: Dec. 14, 2011

(86) PCT No.: PCT/US2011/064999

§ 371 (c)(1),
(2), (4) Date: Jun. 12, 2014

(87) PCT Pub. No.: WO2013/089714

PCT Pub. Date: Jun. 20, 2013

(65) Prior Publication Data

US 2014/0366873 A1 Dec. 18, 2014

(51) Int. Cl.
*A62B 7/08* (2006.01)
*A62B 9/02* (2006.01)
(Continued)

(52) U.S. Cl.
CPC ..... *A62B 7/08* (2013.01); *A62B 7/00* (2013.01); *A62B 9/02* (2013.01); *A62B 9/022* (2013.01); *A62B 9/04* (2013.01); *A62B 7/02* (2013.01)

(58) Field of Classification Search
CPC ..... A61M 16/0833; A61M 16/20; A61M 16/208; A61M 39/14; A61M 39/26;
(Continued)

(56) References Cited

U.S. PATENT DOCUMENTS 5,048,517 A * 9/1991 Pasternack ..... A62B 7/10 128/202.26
5,078,130 A * 1/1992 Van Oosten ..... A62B 18/04 128/201.24
(Continued)

FOREIGN PATENT DOCUMENTS

GB 2470130 A 11/2010
WO WO-2006/108042 A1 10/2006
(Continued)

OTHER PUBLICATIONS

International Search Report and Written Opinion Issued in PCT/US2011/064999 filed Dec. 14, 2011.
(Continued)

*Primary Examiner* — Jan Christopher L Merene
*Assistant Examiner* — Joseph D Boecker
(74) *Attorney, Agent, or Firm* — Design IP

(57) ABSTRACT

A safety breathing apparatus has a delivery element configured to deliver respirable gas to a respiratory system of a user. The apparatus includes a breathing hose in fluid communication with a first source of respirable gas. A valve housing includes a first port configured to be couple to the delivery element, a second port configured to be coupled to the breaking hose, and a third port configured to dock with a second source of respirable gas without exposing the user to a surrounding atmosphere.

22 Claims, 14 Drawing Sheets

(51) Int. Cl.
*A62B 9/04* (2006.01)
*A62B 7/00* (2006.01)
*A62B 7/02* (2006.01)

(58) Field of Classification Search
CPC .. A62B 9/00; A62B 9/02; A62B 9/022; A62B 9/04; A62B 7/00; A62B 7/02; A62B 7/08; A62B 7/12; A62B 18/006; F16L 37/084; F16L 37/086; F16L 37/30; F16L 37/32; F16L 37/36; F16L 37/40; F16L 37/44; F16L 41/02; F16L 41/021; F16L 41/023; F16L 41/03; F16L 41/16; F16L 29/04; F16L 47/285; B63C 11/22; B63C 11/2009; B63C 11/2227; B63C 11/2236
USPC ..... 251/85, 149.1, 149.6, 149.7
See application file for complete search history.

(56) References Cited

U.S. PATENT DOCUMENTS 5,113,854 A * 5/1992 Dosch ..... A62B 7/08 128/201.23
5,318,019 A * 6/1994 Celaya ..... A62B 7/02 128/204.26
5,678,537 A * 10/1997 Bathe ..... A61M 16/104 128/203.12
6,343,603 B1 * 2/2002 Tuck ..... A61M 16/08 128/204.18
6,634,355 B2 * 10/2003 Colas ..... A61M 16/08 128/203.12
6,892,725 B2 * 5/2005 Frund ..... A62B 17/04 128/201.22
7,658,190 B1 * 2/2010 Phifer ..... A62B 7/10 128/201.25
8,256,420 B2 9/2012 Prete
2005/0051169 A1 3/2005 Gossweiler
2008/0178878 A1 * 7/2008 Chambers ..... A62B 9/04 128/202.27
2008/0276934 A1 * 11/2008 Kruger ..... A62B 7/08 128/202.26
2008/0302360 A1 12/2008 Chambers
2010/0326442 A1 * 12/2010 Hamilton ..... A61H 9/0078 128/204.21
2011/0232639 A1 * 9/2011 Latshaw ..... A61D 7/04 128/203.28

FOREIGN PATENT DOCUMENTS

WO 2008/130699 A1 10/2008
WO WO-2011/143485 A2 11/2011

OTHER PUBLICATIONS

Bryd, "TPI gets federal contract for SCSRs," The Times West Virginian, Apr. 15, 2007 (3 pages).
TP Manufacturing, "SCSR+2 the new performance standard in self-rescuers," (2010).

* cited by examiner

HYBRID SELF-RESCUE EQUIPMENT

RELATED APPLICATION

This application is a national stage application, filed under 35 U.S.C. 371, of International Application No. PCT/US2011/064999, filed Dec. 14, 2011, the contents of which are hereby fully incorporated by reference.

TECHNICAL FIELD

The subject matter described herein relates to self-rescue equipment.

BACKGROUND

Self-rescue equipment is used in harsh environments, such as mines, tunnels, and other enclosed spaces where air can become contaminated, toxic, or oxygen deficient atmospheres, for example upon explosion, fire or other event. Workers must avoid breathing the contaminated air during their escape from the environment. Self-rescue equipment is designed to withstand the daily rigors of harsh environments and perform reliably as needed, for example in emergency situations to facilitate escape from the immediately dangerous to life or health (IDLH) environment.

A Self-Contained Self-Rescuer (SCSR) is a portable device that provides breathable air while isolating the wearer's respiratory tract from contaminated or IDLH atmospheres. The SCSR is typically carried, worn or located nearby to a worker providing immediate access to respiratory protection with an oxygen source during the worker's daily tasks. The SCSR provides protection for a limited period of time. Government regulations require coal miners, for example, to have immediate access to an SCSR device that provides respiratory protection for at least 1 hour. The SCSR device provides protection that is generally long enough for a worker to travel and access an additional cache stored at strategic location to facilitate escape in emergencies.

As the respirable gas of the SCSR is depleted, the device is exchanged for another device such as a SCBA (Self-Contained Breathing Apparatus) or another SCSR from a cache positioned along the escape route. The worker will need to doff and re-don the next device in order to receive the fresh supply of respirable gas. Doffing and re-donning requires the worker to hold their breath during the exchange and leaves the worker at risk for exposure to the dangerous atmosphere.

SUMMARY

In one aspect, a safety breathing apparatus is disclosed. The apparatus includes a delivery element configured to deliver respirable gas to a respiratory system of a user. The apparatus includes a breathing hose in fluid communication with a first source of respirable gas. The apparatus also includes a valve housing. The valve housing includes a first port configured to be coupled to the delivery element, a second port configured to be coupled to the breathing hose, and a third port configured to dock with a second source of respirable gas without exposing the user to a surrounding atmosphere.

In addition, the delivery element can include a mouthpiece, a fitted face piece, a full face mask or hood. The first source of respirable gas can include a chemical oxygen cartridge. The chemical oxygen cartridge can be part of a self-contained self-rescuer device. The second source of respirable gas can include a chemical oxygen cartridge. The chemical oxygen cartridge can be part of a self-contained self-rescuer device. The second source of respirable gas can be a compressed air cylinder comprising breathing air. The compressed air cylinder can be part of a self-contained breathing apparatus having a lung demand valve. The valve housing can further include a knob coupled to a cylindrical valve spool rotatably disposed within the valve housing. The knob can be configured to selectively move the cylindrical valve spool a distance around the longitudinal axis of the valve housing between the second port and the third port to create a flow path between the first port and the second port or to create a flow path between the first port and the third port.

The first supply of respirable gas can be removable upon docking the second supply of respirable gas with the third port. The second port can further include a valve element biased into a first, closed position and configured to open upon coupling connection with the first source of respirable gas. The second port can further include a release element configured to release the first source of respirable gas from coupling connection with the second port. The third port can further include a valve element biased into a first, closed position and configured to open upon coupling connection with the second source of respirable gas. The third port can further include a release element configured to release the second source of respirable gas from coupling connection with the third port. The user need not doff or re-don the delivery element during docking. The first source of respirable gas can deliver respirable gas in a different manner than the second source of respirable gas.

In an interrelated aspect, provided is a valve housing can include a first port, a second port, and a third port. The first port is configured to be coupled to a delivery element configured to deliver respirable gas to a respiratory system of a user. The second port is configured to be coupled to a breathing hose in fluid communication with a first source of respirable gas. The third port is configured to dock with a second source of respirable gas without exposing the user to a surrounding atmosphere The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Disclosed herein are devices, systems and methods to quickly, reliably and safely exchange between sources of respirable gas without the user needing to hold their breath or be exposed to a hazardous atmosphere. The source of respirable gas used by the systems disclosed herein can vary including one or more of: oxygen from chemical cartridges or Grade D breathing air from a compressed air cylinder.

Figure 1A:
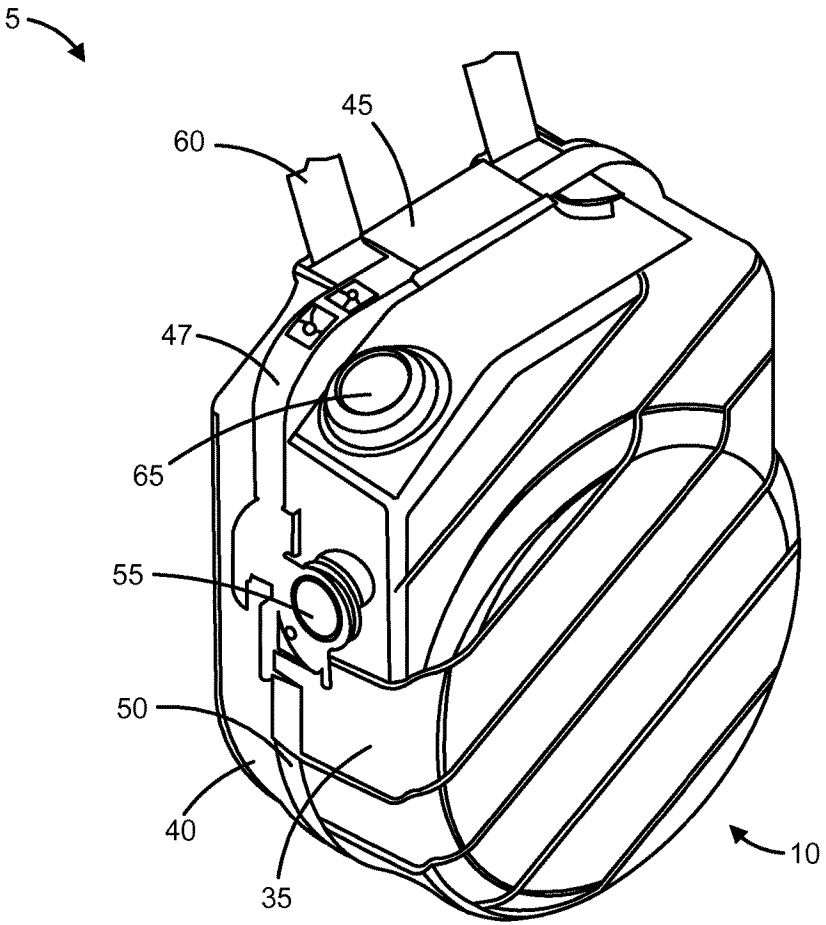
FIG. 1A is a perspective view of an implementation of a hybrid SCSR system in a closed, inactive configuration.
Figure 1B:
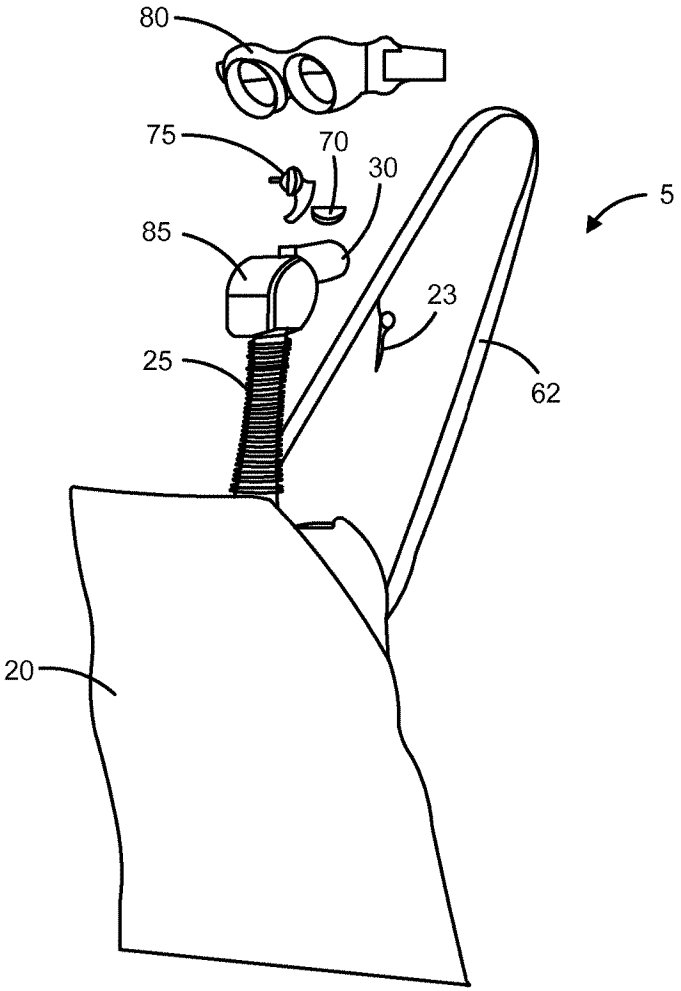
FIG. 1B is a perspective view of the hybrid SCSR system of FIG. 1A in an opened, activated configuration.

FIG. 1A illustrates an implementation of a hybrid SCSR system 5 in a closed, inactive configuration and FIG. 1B illustrates the hybrid SCSR system 5 in an opened, activated configuration. The system 5 can include a housing 10 inside of which is sealed a chemical oxygen cartridge 15 (see FIG. 3), breathing bag 20, breathing hose 25 and mouthpiece 30. It should be appreciated that the system 5 can include instead of a mouthpiece 30 another type of delivery element configured to deliver a supply of respirable gas to a respiratory system of a user such as a fitted face piece, full face mask and/or hood type coupling instead of the described mouthpiece 30. As will be described in more detail below, a valve housing 85 is positioned between the breathing hose 25 and the mouthpiece 30 that allows a user to dock with additional sources of respirable gas via one or more ports in the valve housing 85 without needing to doff and re-don the device. The valve housing 85 may also contain a heat exchanger to keep the temperature of the inhaled breathing air to an acceptable level of the comfort of the user.

The system 5 can be used for confined space applications such as escape from mine shafts, tunnels or tanks, but it should be appreciated that the system 5 may be used in any environment in which there is a risk of exposure to dangerous substances in the surrounding atmosphere or reduced oxygen content in IDLH atmospheres. The system 5 can have application in military and law enforcement use as well as in industrial uses.

The housing 10 enclosing the system 5 is configured to protect the system 5 from damage due to the harsh environment to which the system 5 could be exposed. Materials and construction of the housing 10 can be designed to withstand challenging and harsh environments such as dirt, dust, particulate, sudden and hard impact, and exposure to heat, water and other environmental elements. The housing 10 can be made of composite materials to increase strength and reduce transfer of impact shock to internal components such as the chemical oxygen cartridge 15.

The housing 10 can include a cover 35 and a wear plate 40. The system 5 can be belt mounted with a standard belt clip or can optionally be used with a carrying pouch. In some implementations, the wear plate 40 of the housing 10 can include one or more adjustable straps 60 coupled to an external portion of the system such that the system 5 can be worn by the user. The straps 60 can be used to wear the system 5 around a user's waist, chest, neck or shoulders bandolier style during non-emergencies. An additional strap 62 can also be positioned internal to the system as shown in FIG. 1B and can be made available when the housing 10 is opened for use. The strap 62 can be positioned around a user's neck and one or more additional straps can be wrapped around the user's waist or tied to keep the system close to the body during use. The straps 60, 62 can be adjustable with a variety of adjustment mechanisms. The housing 10 can also include one or more indicators 65 readily visible to a user. The indicators 65 can be positioned near an upper surface of housing 10 or a surface of the housing 10 facing a user when not in use such that the user can know that the system 5 is safe to use. The indicators 65 can vary including but not limited to one or more light emitting diodes (LED) in one or more colors, bulbs, digital graphic display or other visual, auditory and/or tactile indicator.

Figure 2A:
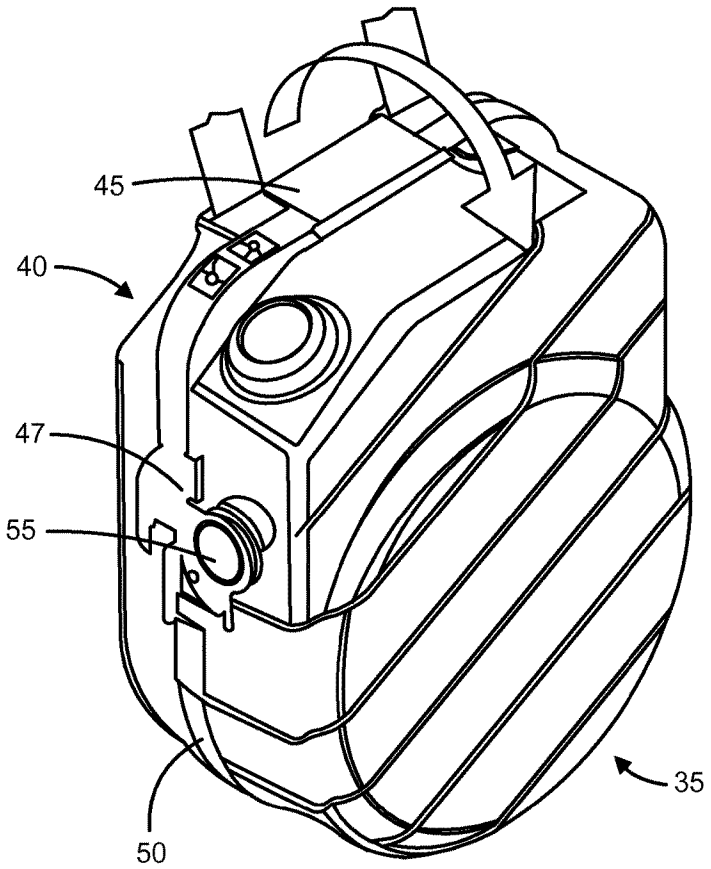
FIGS. 2A-2C are perspective views of the hybrid SCSR system of FIG. 1A in various stages of opening and actuation.
Figure 2B:
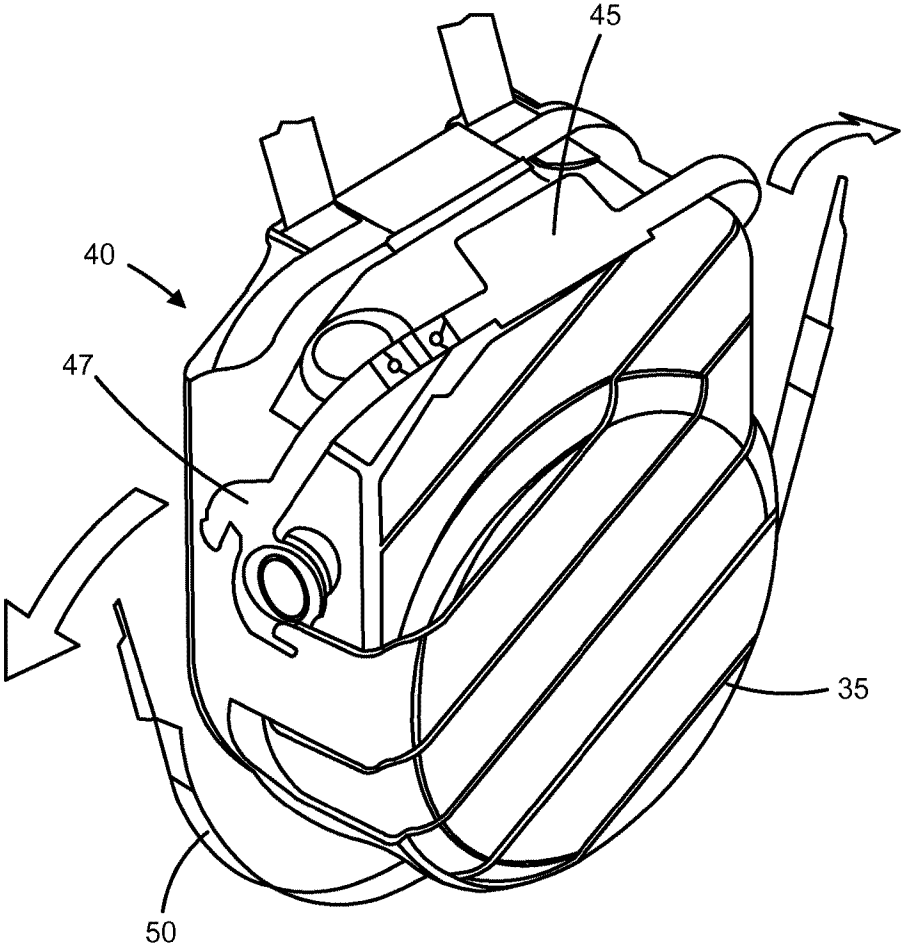
Figure 2C:
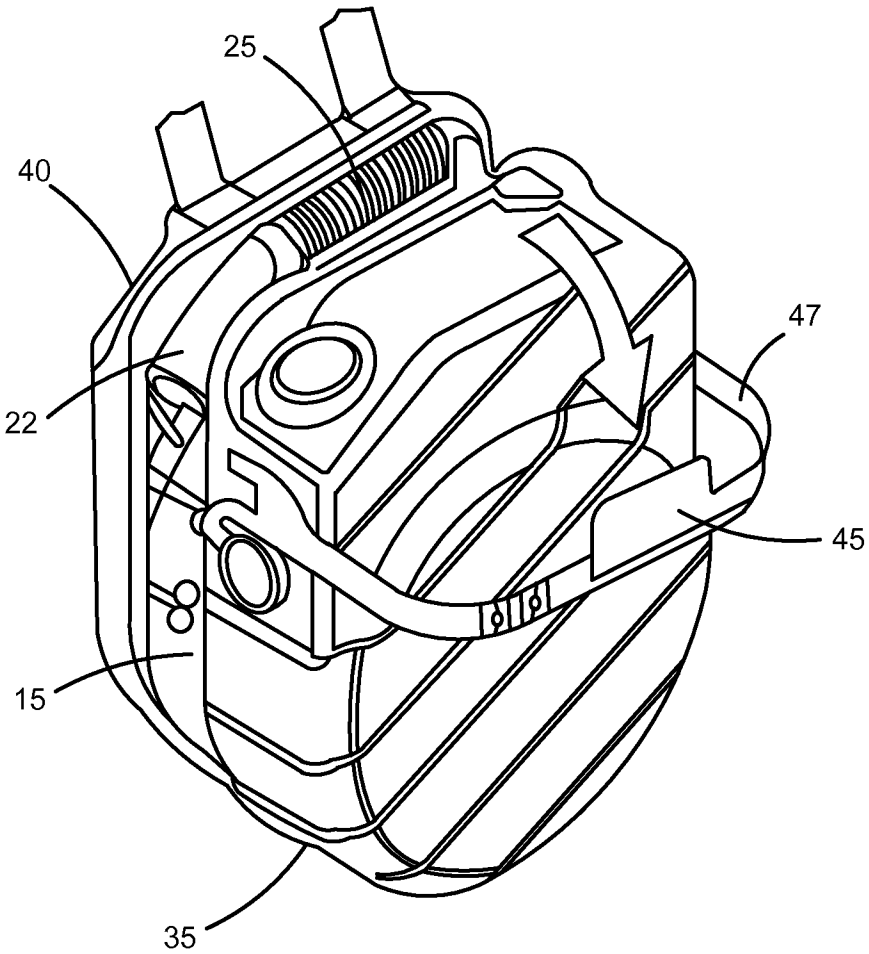

As best shown in FIGS. 2A-2C, the cover 35 can be easily and quickly removed from the wear plate 40 upon actuation of an opening mechanism 45. The opening mechanism 45 can release the cover 35 of the housing 10 for removal. In some implementations, the opening mechanism 45 can include a flip-release opening mechanism 45 in which the system 5 can be unsealed and both halves of the housing 10 separated. A sealing strip 50 sealing the housing 10 can fall off automatically as the arm 47 of the opening mechanism 45 is rotated about a hinge element 55. This type of opening mechanism 45 can allow for a user to access the internal components such as the mouthpiece 30 and rapidly don the system 5 with minimal effort.

Figure 3:
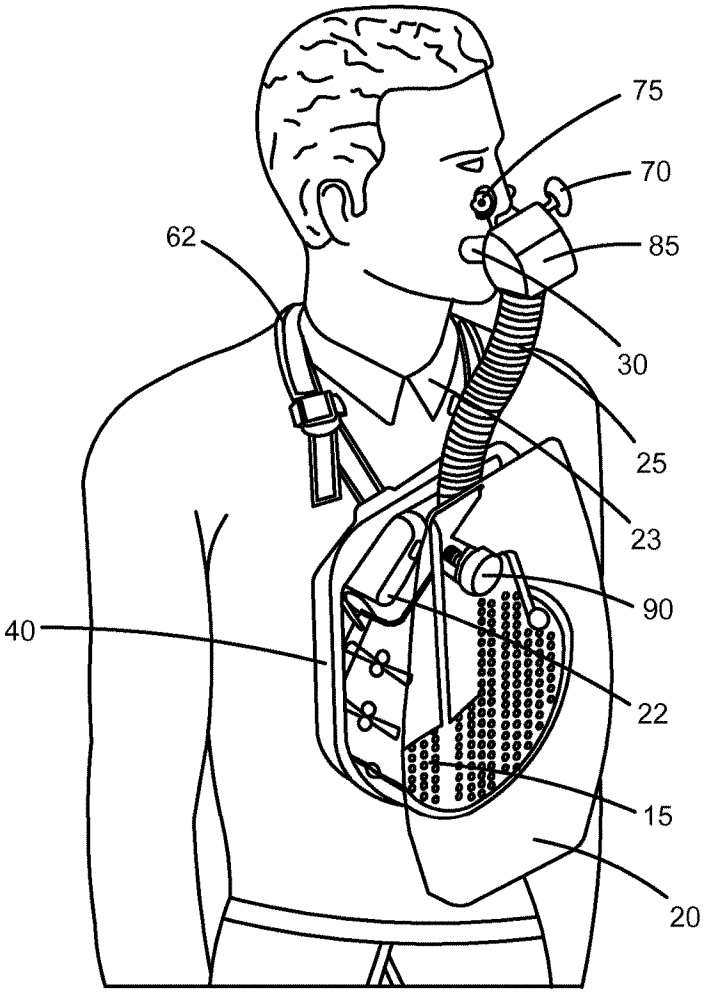
FIG. 3 is a perspective view of a hybrid SCSR system in active use by a user.

As shown in FIG. 3, once the cover 35 is removed the breathing bag 20, breathing hose 25 and mouthpiece 30 enclosed by the housing 10 can be made available to a user. The mouthpiece 30 can be stored in the housing 10 having a removable plug 70 positioned within the air passageway of the mouthpiece 30. The plug 70 can be removed prior to inserting the mouthpiece 30 into a user's mouth. The system 5 can also include a nose clip 75 and goggles 80. The nose clip 75 and/or goggles 80 can be stored within the housing 10 of the system 5 and made available upon removal of the cover 35. Alternatively, the nose clip 75 and/or goggles 80 can be provided by a user separately from the system 5.

As shown in FIG. 3, the system 5 can include a starter 22 that can provide enough oxygen for the first few minutes before the subsequent reaction in the chemical oxygen cartridge 15 starts. The starter 22 can automatically activate upon opening the housing 10. Alternatively, the system 5 can include an activation pin 23 for the starter 22 that can be activated by a user when positioning valve housing 85 toward the mouth.

Breathing resistance pressure can be maintained within a comfortable range or zone for a user undergoing mild exertion (e.g. walking). For example, a pressure relief valve 90 can be positioned between the breathing bag 20 and the breathing tube 25 (see FIG. 3). The valve 90 can control the air volume in the breathing bag 20. In some implementations, the system 5 can have between about 4 mbar to about 6 mbar inhalation/exhalation resistance.

Still with respect to FIG. 3, the breathing hose 25 can connect the mouthpiece 30 to the breathing bag 20 in fluid communication with the chemical oxygen cartridge 15 via a valve housing 85, as will be discussed in more detail below. The chemical oxygen cartridge 15 can be both an oxygen source and a carbon dioxide absorber. The chemical oxygen cartridge 15 can provide a breathing gas containing oxygen and recycled exhaled gas. In some implementations, the chemical oxygen cartridge 15 can be a Potassium Super Oxide ($KO_2$) cartridge, which gives off oxygen as it absorbs carbon dioxide. The chemical oxygen cartridge 15 can have a limited usage period and can be depleted over a period of time. In some implementations, the chemical oxygen cartridges 15 can have a usage period in the range of approximately 10 minutes, 15 minutes, 20 minutes, 30 minutes, 40 minutes, 50 minutes, 60 minutes, 90 minutes, or 180 minutes or longer. It should be appreciated that the usage periods of the chemical oxygen cartridges 15 can vary. It should also be appreciated that the system 5 can accept a chemical oxygen cartridge 15 having any usage period and the above are only examples.

Generally, the hybrid SCSR system 5 provides respiratory protection for a limited period of time that is enough for a user to travel to and access a cache of devices positioned, for example, along an escape route. The cache of devices can provide additional oxygen or air supply time. The system 5 allows a user to exchange the respiratory protection of the spent SCSR for the respiratory protection of an additional device without exposing the user to the dangerous atmosphere or forcing the user to hold their breath. In some implementations, another fully-charged SCSR system can dock with the system 5. In other implementations, a SCBA having a full compressed breathing air cylinder can dock with the system 5. The user can don the SCSR system 5 in an emergency and travel towards a SCBA storage location positioned along an escape route. The user can then don the SCBA system and dock the SCBA system with the SCSR system to provide respiratory protection from the SCBA system without being exposed to the dangerous atmosphere.

Figure 4:
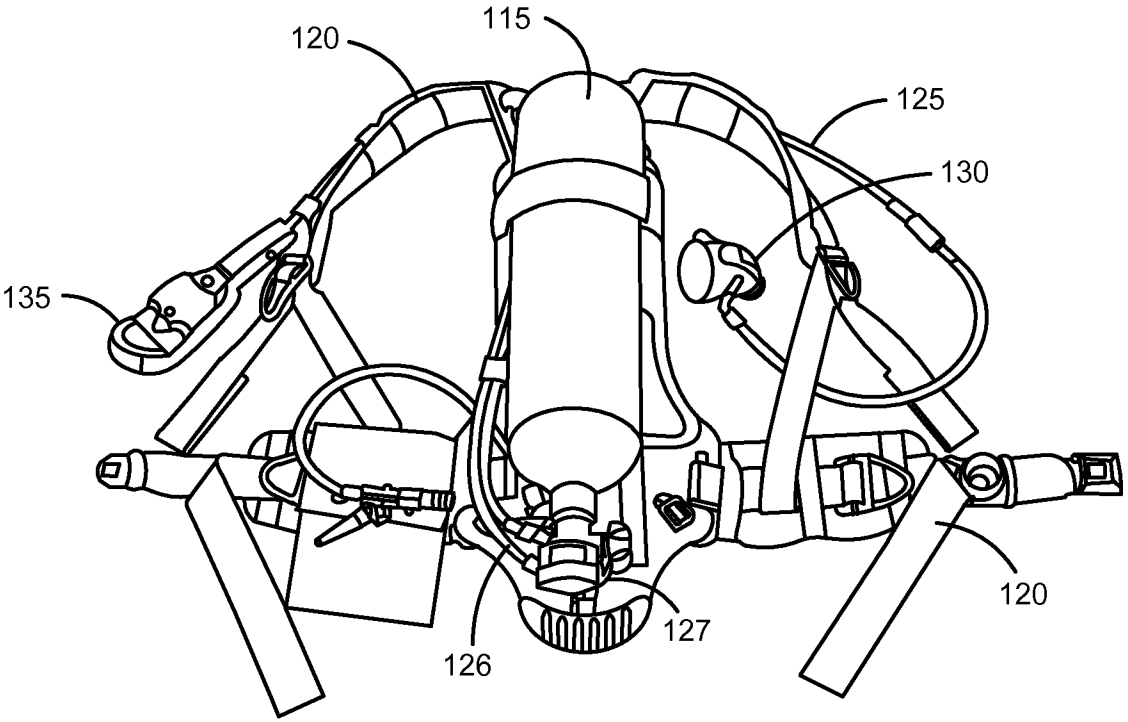
FIG. 4 is a schematic, front view of a SCBA system.

As shown in FIG. 4, a SCBA system 405 can include a compressed breathing air cylinder 115 coupled to a harness 120. The compressed breathing air cylinder 115 can be coupled to a line 125 that can lead from the first stage pressure reducer 127 to a lung demand valve 130. The SCBA 405 can also include a pressure gauge 135 connected by an additional line 126 to the high-pressure side of first-stage pressure reducer 127 to determine remaining compressed breathing air pressure. The SCBA can include a high pressure connection such that the breathing air cylinder 115 can be recharged while in use. As such, a user wearing and breathing air from the SCBA can periodically recharge the cylinder 115, for example using a fill station located along an exit route.

Figure 5:
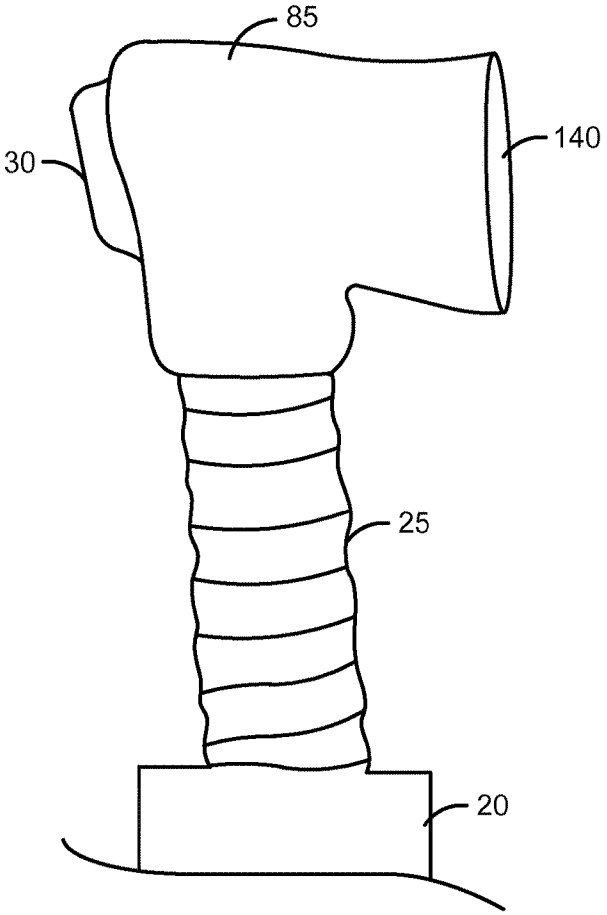
FIG. 5 is a schematic, front view of a valve housing coupled to a breathing hose of a SCSR system.

As mentioned above and as shown in FIG. 5, the breathing hose 25 of the hybrid SCSR system 5 can connect the mouthpiece 30 to the breathing bag 20 via the valve housing 85. The valve housing 85 can include a side port 140 through which an additional respirable gas supply can be docked, such as the lung demand valve 130 of the SCBA 405 or another SCSR. The side port 140 allows for a user to switch between the source of respirable gas without the user needing to hold his breath or be exposed to a hazardous atmosphere. With the mouthpiece 30 still in position and providing respirable gas to the user, a device such as the lung demand valve 130 of the SCBA system can be inserted into side port 140. The SCBA system can automatically begin providing respirable gas to the user through the valve housing 85, such as upon the first breath. The valve housing 85 can also be configured to be switched from the SCSR respirable gas source to the SCBA respirable gas source or other source, such as with a rotary valve housing 85 as will be described below.

Figure 6A:
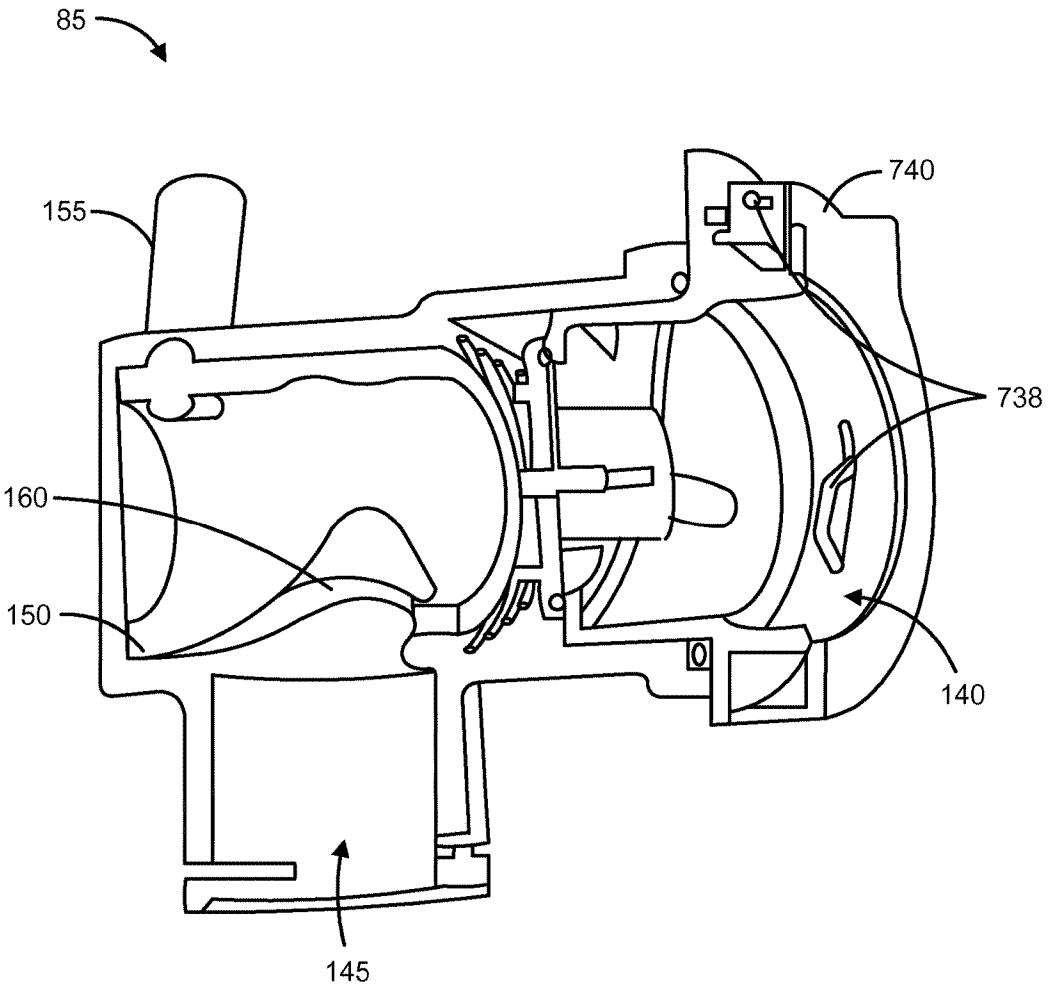
FIGS. 6A-6B are front, cross-sectional views of an implementation of a valve housing.
Figure 6B:
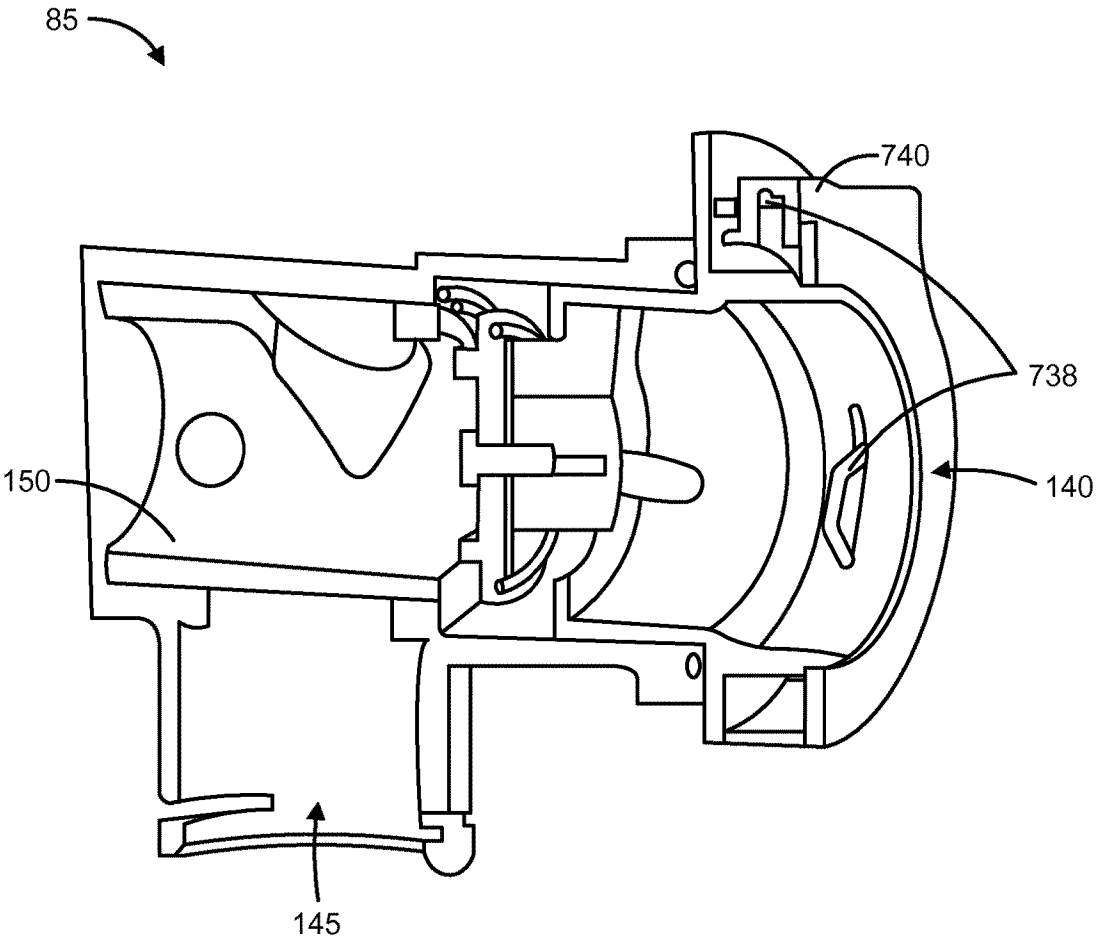

An implementation of the valve housing 85 is shown in FIGS. 6A-6B that allows the user to select the respirable gas supply docked at the respective ports 140, 145. Port 145 can be configured to couple to a proximal end of breathing hose 25 extending from breathing bag 20 of the SCSR system 5. The port 145 and a corresponding element on the breathing hose 25 can couple together forming an airtight seal. The side port 140 can be configured to couple with the lung demand valve 130 as will be described in more detail below. It should be appreciated that the side port 140 can be configured to couple to other breathing devices and is not limited to a lung demand valve of a SCBA system. Further, one or both of the ports 140, 145 can be covered by a dust cap when not in use or include a protective covering that can be pierced through, such as by the lung demand valve 130.

The valve housing 85 can include a cylindrical valve spool 150 that can be rotatably disposed within the valve housing 85. Upon connection with an additional device docked within the side port 140, the cylindrical valve spool 150 can be rotated by a user using knob 155 to move the valve spool 150 a distance around the longitudinal axis of the valve housing 85. The valve spool 150 can be rotated such that an opening 160 in the valve spool 150 moves out of alignment with port 145 and closes off the passageway from the SCSR system 5 (see FIG. 6B). The passageway through the side port 140 can remain open and in fluid communication with the device docked with the side port 140, such as the lung demand valve 130 of a SCBA system. Once the passageway is created, the breathing tube 25 can be disconnected from the port 145 and removed. The knob 155 can include a mechanism that prevents inadvertent rotation of the valve spool 150.

Figure 7A:
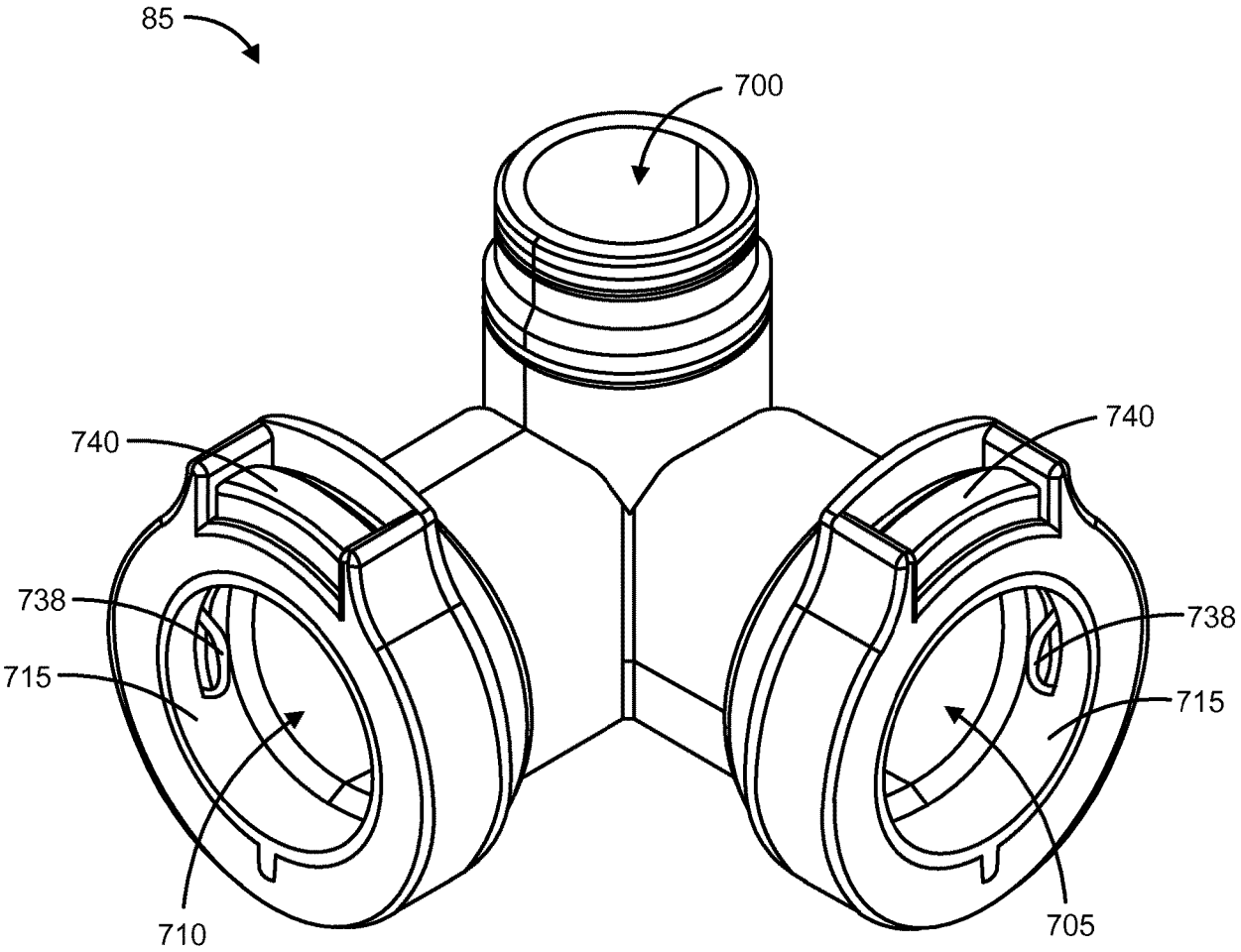
FIG. 7A is a front view and FIGS. 7B and 7C are cross-sectional views of another implementation of a valve housing.
Figure 7B:
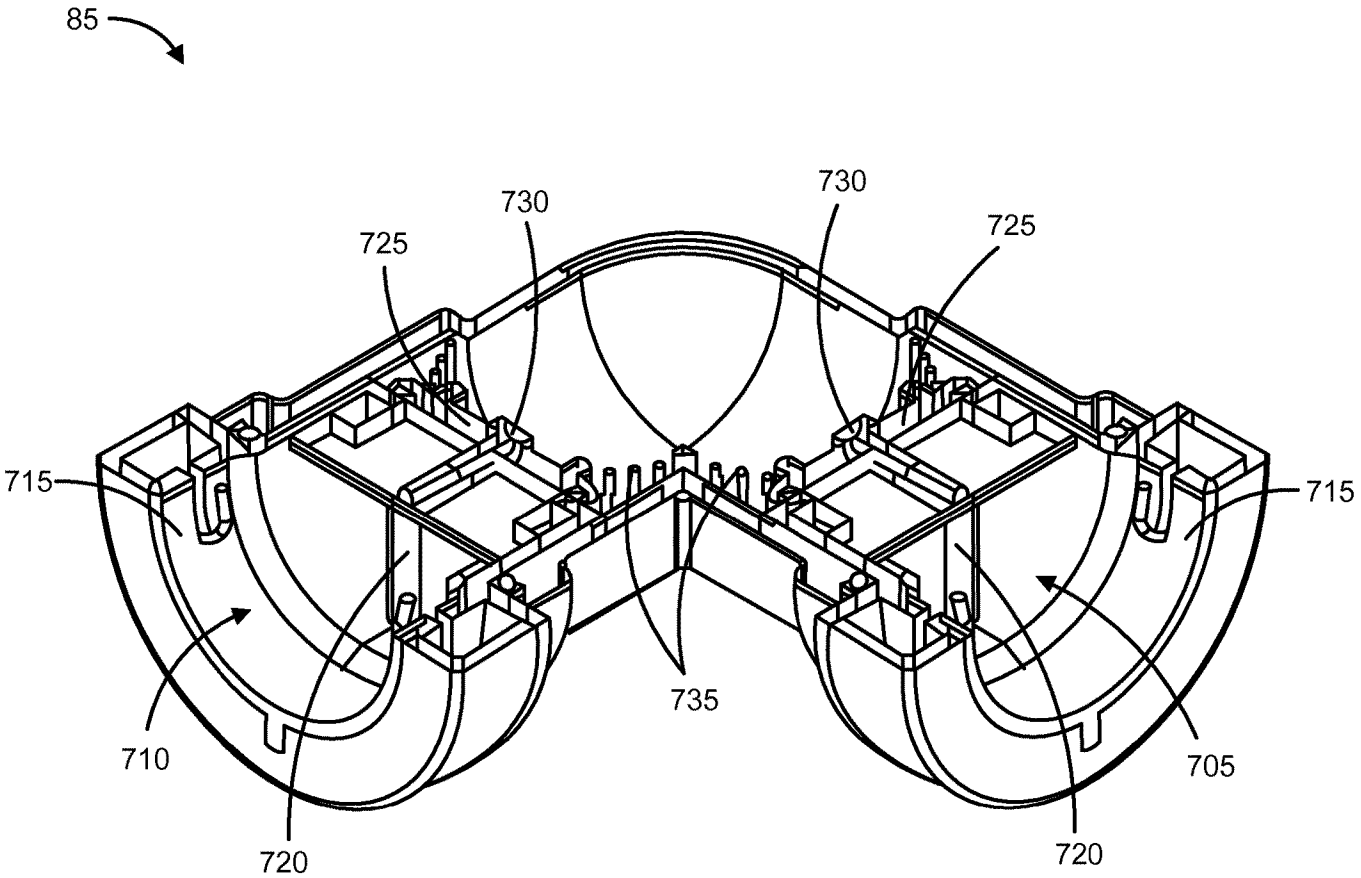
Figure 7C:
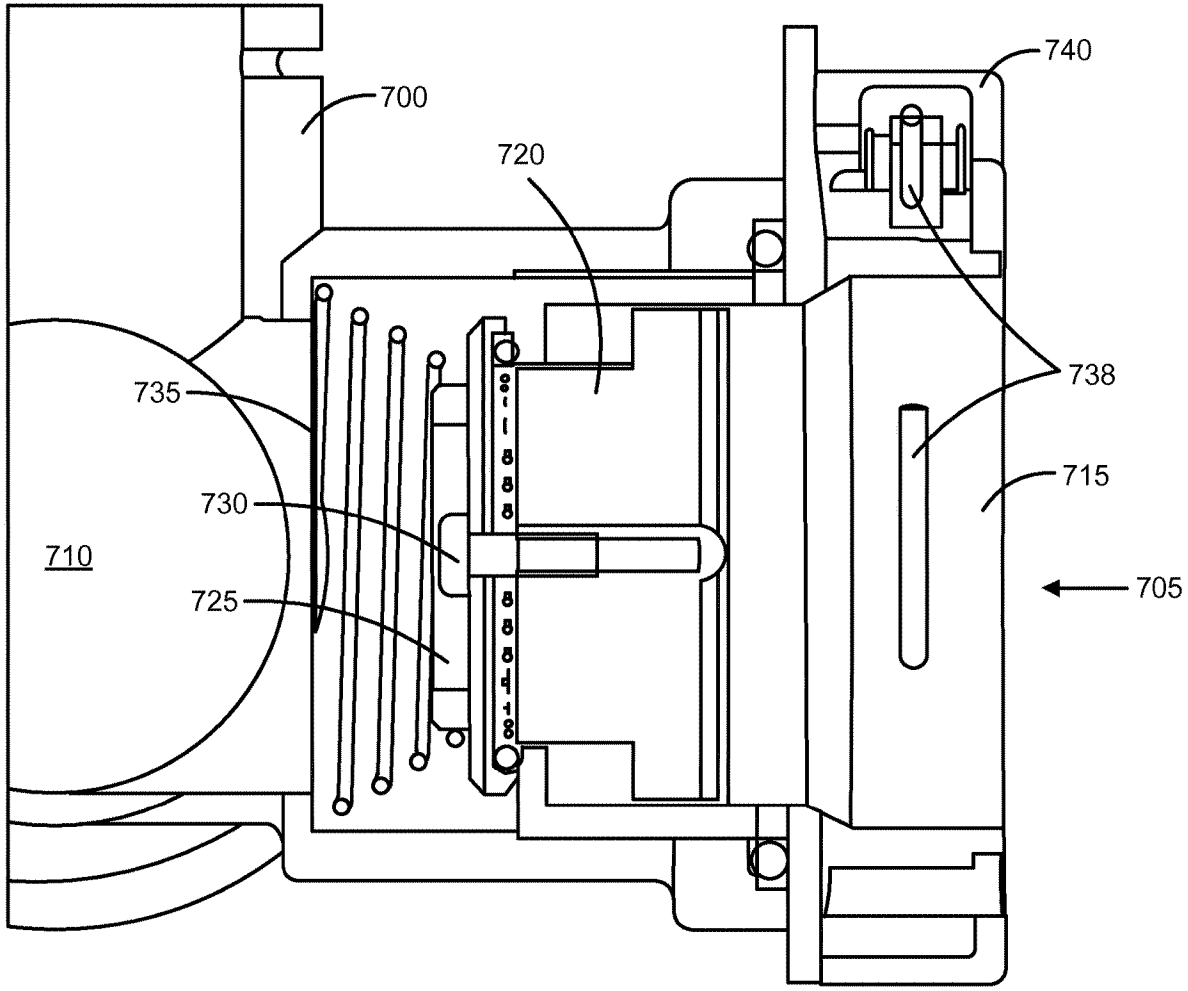

FIGS. 7A-7C illustrate another implementation of a valve housing 85 for use with the systems described herein. The valve housing 85 can have a first port 700 and two valved side ports 705, 710 for connection with additional respirable gas supplies. In use, the port 700 can be coupled to a respiratory inlet cover, for example, full face piece or hood with the breathing tube 25 of the SCSR system 5 coupled to ports 705 or 710. Upon depletion of the SCSR connected at a first port (either 705 or 710), the user can dock an additional supply of respirable gas at the available port. Once the additional supply is operational, the user can unplug the first. The type of device that can be docked with the ports 705, 710 can vary including another SCSR, a SCBA, or any other protective device that can be plugged in, such as a filter.

Still with respect to FIGS. 7A-7C, each port 705, 710 can include a valve connector 715 surrounding valve element 720 coupled to valve element 725 by valve screw 730. Valve element 725 can be biased into a first, closed position such as with a spring element 735. Upon insertion of a device into either port 705, 710, inward pressure is applied against valve element 720. Valve element 720 can travel a distance within the port to apply force against valve element 725 in a direction that compresses spring 735 to open the flow pathway. The device inserted within the port 705, 710 can snap-fit within the valve connector 715 such that the flow pathway between the gas supply and the valve housing is maintained in an open configuration. To release the connection with the device, each port 705, 710 can include a release element such as a button 740 that allows for the device to be pulled free from the port and discarded. The device can be captured by a mechanical element 738, such as a spring clip, to prevent removal until the release button 740 is depressed to release the device form the port 705, 710. The ports 705, 710 can be automatically opened upon docking with a device and automatically closed upon removal of the device.

Figure 7D:
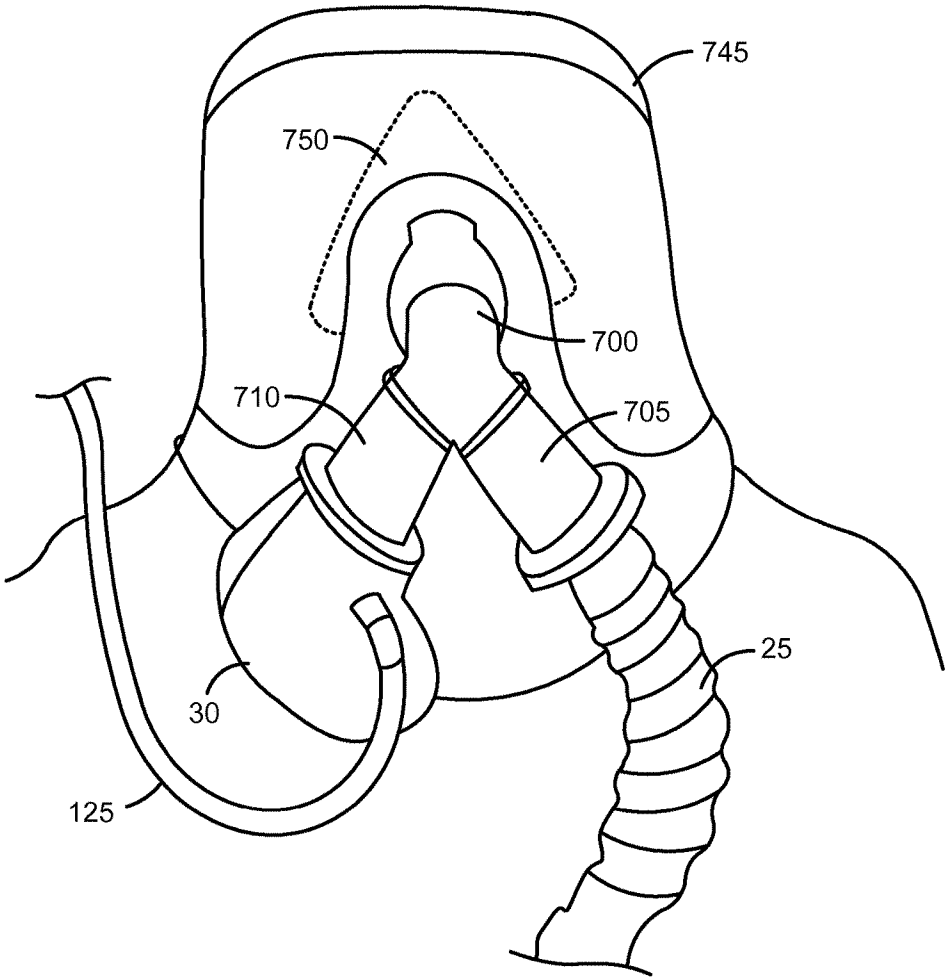
FIG. 7D illustrates an implementation of the valve housing of FIG. 7A connected to a hood having an inner mask.

FIG. 7D illustrates an implementation of SCBA and SCSR both connected to a hood 745 having an inner mask 750. The SCSR breathing tube 25 is shown coupled to port 705 and SCBA lung demand valve 130 is shown coupled to port 710. The coupling connection at each port 705, 710 can be interchangeable in that breathing tube 25 can be coupled to port 710 and the lung demand valve 130 can be coupled to port 705. As described above, when one device (either the lung demand valve 130 or the breathing tube 25) is disconnected the valve within the respective port closes preventing contamination.

The implementations set forth in the foregoing description do not represent all implementations consistent with the subject matter described herein. Instead, they are merely some examples consistent with aspects related to the described subject matter. Wherever possible, the same reference numbers will be used throughout the drawings to refer to the same or like parts.

Although a few implementations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. In addition, the logic flows and steps for use described herein do not require the particular order shown, or sequential order, to achieve desirable results. Other implementations can be within the scope of the claims.

What is claimed is:

1. A safety breathing apparatus comprising:

a delivery element configured to deliver respirable gas to a respiratory system of a user;

a breathing hose in fluid communication with a first source of respirable gas; and a valve housing comprising:

a first port configured to be coupled to the delivery element;

a second port configured to be detachably coupled to the breathing hose, wherein the second port comprises a first valve element biased in a first configuration that prevents gas flow through the second port, wherein in a second configuration the first valve element allows gas flow through the second port upon a coupling connection with the breathing hose, and wherein the first valve element returns to the first configuration upon de-coupling of the breathing hose from the second port; and a third port configured to detachably dock with a second source of respirable gas, wherein the third port comprises a second valve element biased in a first configuration that prevents gas flow through the third port, wherein in a second configuration the second valve element allows gas flow through the third port upon a coupling connection with the second source of respirable gas, and wherein the second valve element returns to the first configuration upon de-coupling of the second source of respirable gas from the third port, wherein a bi-directional flow path through the valve housing is either between the first port and the second port or the first port and the third port.

2. The apparatus of claim 1, wherein the delivery element comprises a mouthpiece, a fitted face piece, a full face mask or hood.

3. The apparatus of claim 1, wherein the first source of respirable gas comprises a chemical oxygen cartridge.

4. The apparatus of claim 3, wherein the chemical oxygen cartridge is part of a self-contained self-rescuer device.

5. The apparatus of claim 1, wherein the second source of respirable gas comprises a chemical oxygen cartridge.

6. The apparatus of claim 5, wherein the chemical oxygen cartridge is part of a self-contained self-rescuer device.

7. The apparatus of claim 1, wherein the second source of respirable gas comprises a compressed air cylinder comprising breathing air.

8. The apparatus of claim 7, wherein the compressed air cylinder is part of a self-contained breathing apparatus comprising a lung demand valve.

9. The apparatus of claim 1, wherein the valve housing further comprises a knob coupled to a cylindrical valve spool rotatably disposed within the valve housing.

10. The apparatus of claim 9, wherein the knob is configured to selectively move the cylindrical valve spool a distance around the longitudinal axis of the valve housing to a first position between the second port and the third port to create the bi-directional flow path between the first port and the second port or to a second position to create the bi-directional flow path between the first port and the third port.

11. The apparatus of claim 1, wherein the first supply of respirable gas is removable upon docking the second supply of respirable gas with the third port.

12. The apparatus of claim 1, wherein in the second configuration of the first valve element, the coupling connection of the second port with the breathing hose results from inward pressure against the first valve element, the inward pressure compressing a first spring of the valve housing that opens the second port and allows gas flow through the second port.

13. The apparatus of claim 1, wherein the second port further comprises a release button configured to release the first source of respirable gas from coupling connection with the second port upon being depressed.

14. The apparatus of claim 1, wherein in the second configuration of the second valve element, the coupling connection of the third port with the second source of respirable gas results from inward pressure against the second valve element, the inward pressure compressing a second spring of the valve housing that opens the third port and allows gas flow through the third port.

15. The apparatus of claim 1, wherein the third port further comprises a release button configured to release the second source of respirable gas from coupling connection with the third port upon being depressed.

16. The apparatus of claim 1, wherein the user need not doff or re-don the delivery element during docking.

17. The apparatus of claim 1, wherein the first source of respirable gas delivers respirable gas in a different manner than the second source of respirable gas.

18. The apparatus of claim 1, wherein the second port extends to an external face of the valve housing and the third port extends to another external face of the valve housing.

19. A valve housing comprising:

a first port configured to be coupled to a delivery element configured to deliver respirable gas to a respiratory system of a user;

a second port configured to be detachably coupled to a breathing hose in fluid communication with a first source of respirable gas, wherein the second port comprises a first valve element biased in a first configuration that prevents gas flow through the second port, wherein in a second configuration the first valve element allows gas flow through the second port upon a coupling connection with the breathing hose, and wherein the first valve element returns to the first configuration upon de-coupling of the breathing hose from the second port; and a third port configured to detachably dock with a second source of respirable gas, wherein the third port comprises a second valve element biased in a first configuration that prevents gas flow through the third port, wherein in a second configuration the second valve element allows gas flow through the third port upon a coupling connection with the second source of respirable gas, and wherein the second valve element returns to the first configuration upon de-coupling of the second source of respirable gas from the third port, wherein a bi-directional flow path through the valve housing is either between the first port and the second port or the first port and the third port.

20. The valve housing of claim 19, further comprising the first source of respirable gas, wherein the first source of respirable gas comprises a chemical oxygen cartridge.

21. The valve housing of claim 19, wherein the second source of respirable gas comprises a chemical oxygen cartridge.

22. The valve housing of claim 19, wherein the second port extends to an external face of the valve housing and the third port extends to another external face of the valve housing.

* * * * *